United States Patent [19]

Pain

[11] 4,146,088

[45] Mar. 27, 1979

[54] HEAT EXCHANGER

[76] Inventor: Ronald A. Pain, Susan St., Eltham, Victoria, Australia

[21] Appl. No.: 732,783

[22] Filed: Oct. 15, 1976

[51] Int. Cl.[2] ..... F28D 7/10

[52] U.S. Cl. ..... 165/141

[58] Field of Search ..... 165/140, 141, 167

[56] References Cited

U.S. PATENT DOCUMENTS

| | | | |
|---|---|---|---|
| 2,499,384 | 3/1950 | Holm et al. | 165/141 |
| 2,596,008 | 5/1952 | Collins | 165/167 |
| 3,303,877 | 2/1967 | Ramen | 165/141 |
| 3,397,742 | 8/1968 | Venssen et al. | 165/167 |

FOREIGN PATENT DOCUMENTS

| | | | |
|---|---|---|---|
| 402788 | 9/1968 | Australia | 165/141 |

*Primary Examiner*—Charles J. Myhre
*Assistant Examiner*—Theophil W. Streule, Jr.
*Attorney, Agent, or Firm*—Bacon & Thomas

[57] ABSTRACT

A heat exchanger for fluids comprising a plurality of coaxially arranged tubes of thermally conductive material, the tubes being spaced apart radially by end manifolds to form annular fluid flow passages, characterized in that at least one of the manifolds includes sealing surfaces which bear against and form seals with the inside surfaces of the ends of the tubes. The arrangement is such that sealing contact is made with the inside end surfaces of the tubes and thereby enabling the manifolds to be of much lighter weight and thus less expensive to cast.

11 Claims, 8 Drawing Figures

HEAT EXCHANGER

This invention relates to improved heat exchangers for fluid and particularly of the type disclosed in Australian Pat. No. 402788.

The heat exchanger disclosed in the patent noted above comprises a plurality of concentrically arranged tubes having corrugated fluid contact surfaces, the tubes being spaced apart to form annular fluid flow passages through which the fluids are caused to flow so that exchange of heat takes place through the corrugated contact surfaces of the tube. The corrugations may comprise individual circumferencially disposed axially spaced apart grooves which, between adjacent grooves, define crests. In a preferred form however the corrugations of each tube comprise a single, continuous helical groove. The helical grooves of all of the tubes are of equal pitch and the assembly of the tubes in the exchanger is effected by screwing one tube within or about the next largest or smallest tube in the exchanger.

The tubes are maintained in their correct radial spacing by means of end manifolds which also serve as inlet and outlet manifolds for the fluids. Each end manifold has a generally conical opening into which the ends of the tubes are inserted. Formed at spaced locations on the surface of the opening are stepped recesses for forming seals with the ends of the various tubes, openings being left at selective locations for providing inlet and outlet ducts to the annular passages between the tubes. This arrangement is quite satisfactory, however, since the end manifolds are usually cast from bronze or stainless steel, their manufacturing cost is very high. The object of the present invention is to provide an improved heat exchanger in which at least one of its end manifolds, but preferably both, is of modified construction and which can be formed substantially lighter than the manifolds described above.

According to the present invention there is provided a heat exchanger for fluids comprising a plurality of coaxially arranged tubes of thermally conductive material, the tubes being spaced apart radially by end manifolds to form annular fluid flow passages, characterised in that at least one of the manifolds includes sealing surfaces which bear against and form seals with the inside surfaces of the ends of the tubes.

It is preferred that the manifolds at either end of the heat exchanger are identical and each has a respective sealing surface for each tube.

It is further preferred that the manifolds are generally conical in shape and have progressively larger sealing surfaces spaced axially therealong for cooperating with the interior surfaces of progressively larger diameter tubes of the exchanger.

Figure 1:
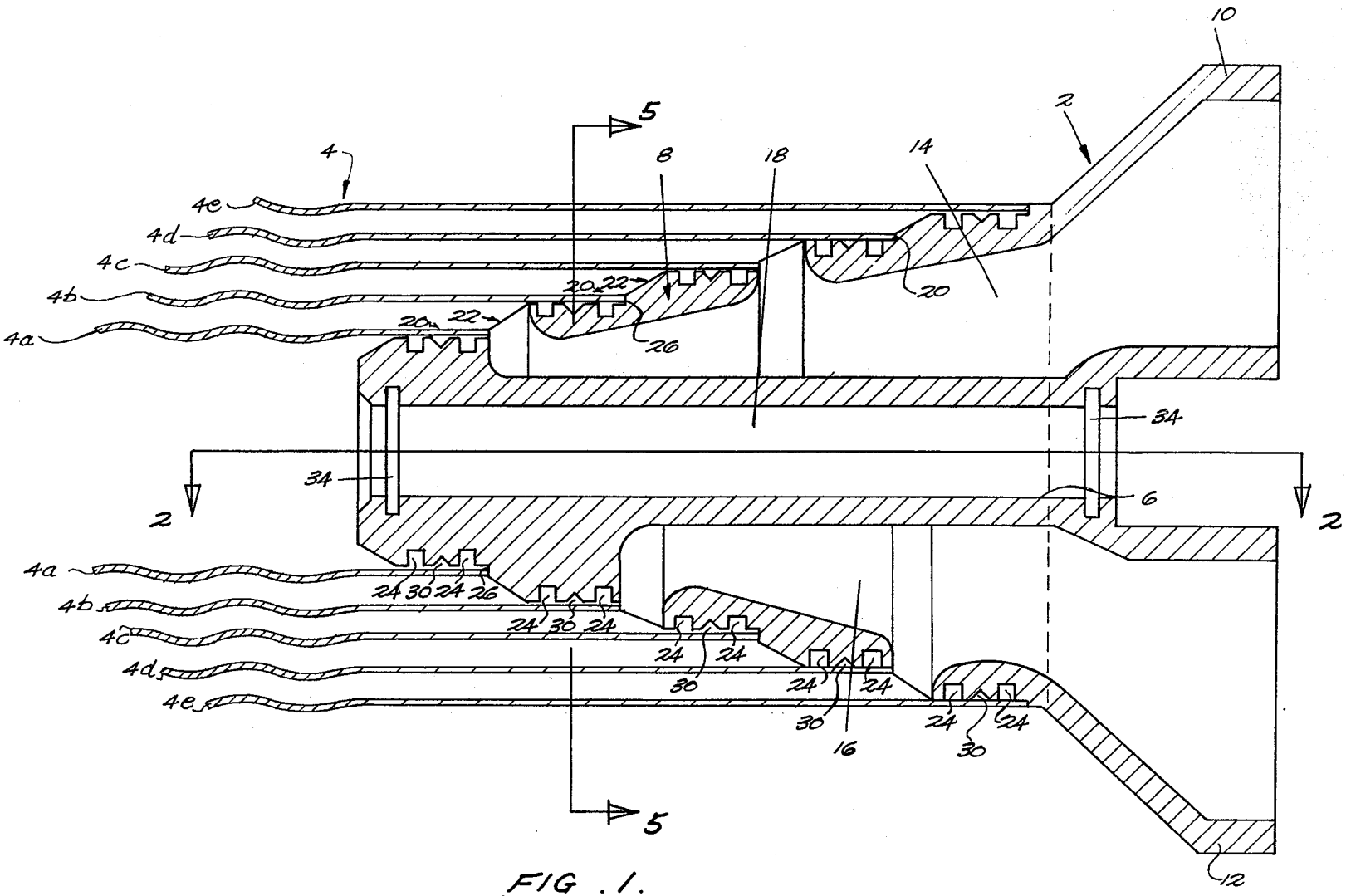
Figure 2:
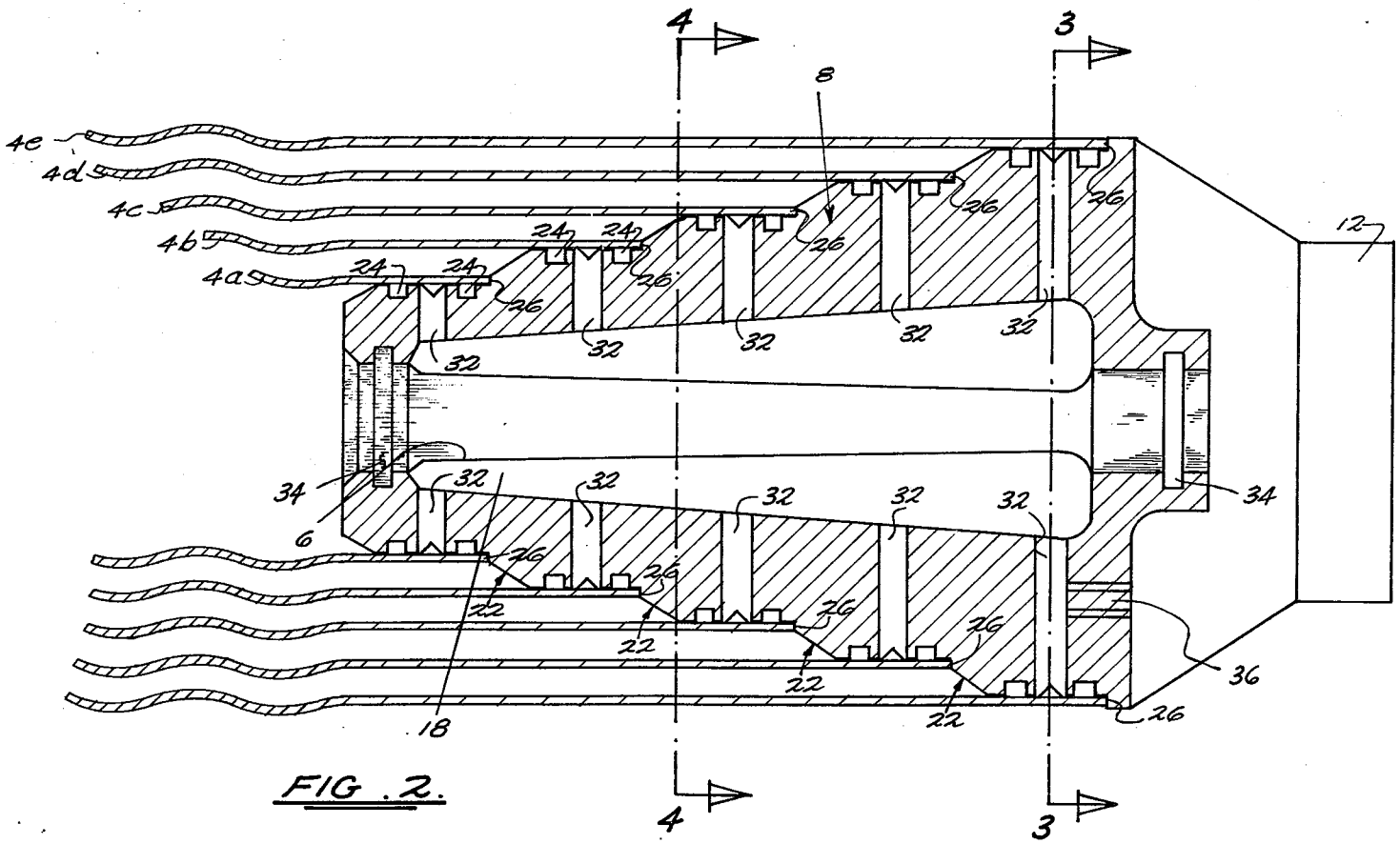
Figure 6:
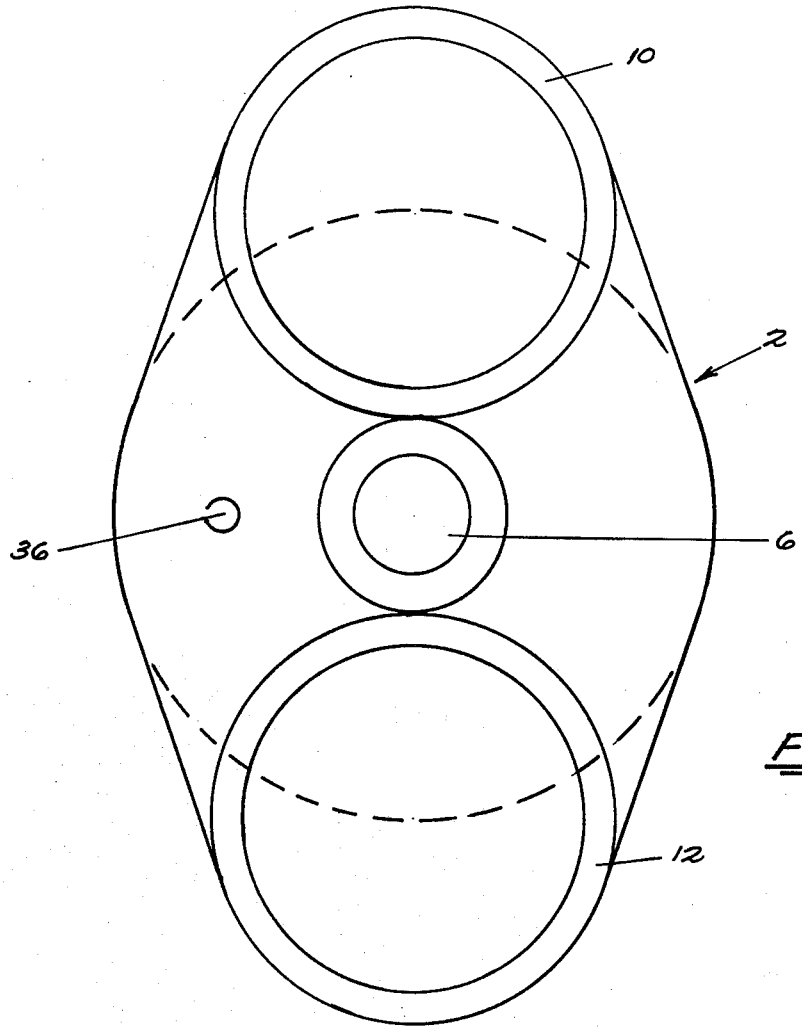
Figure 3:
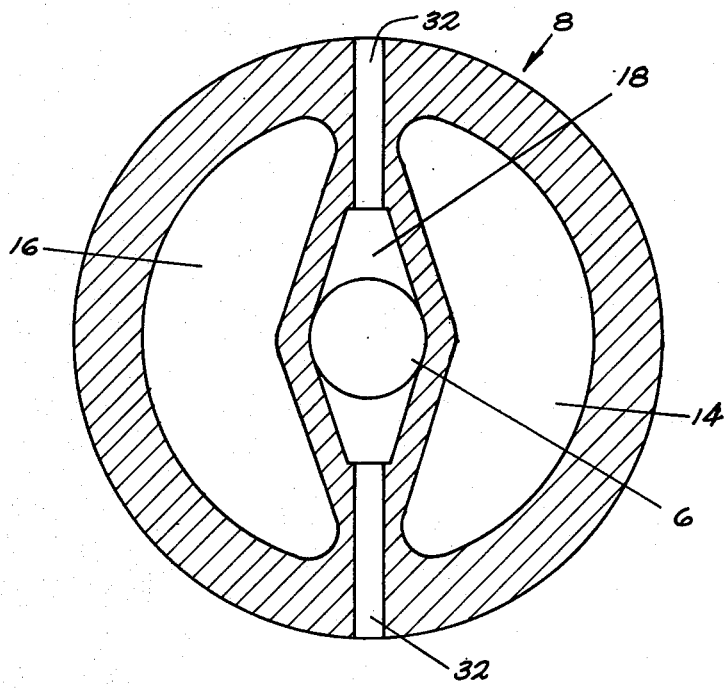
Figure 5:
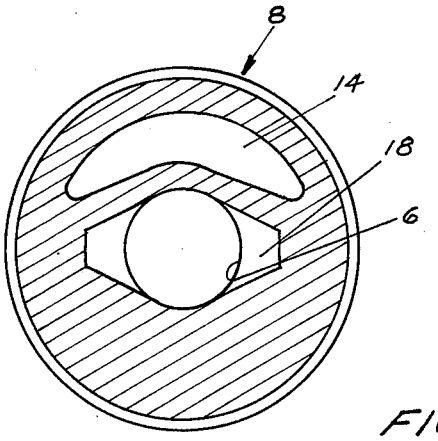
Figure 7:
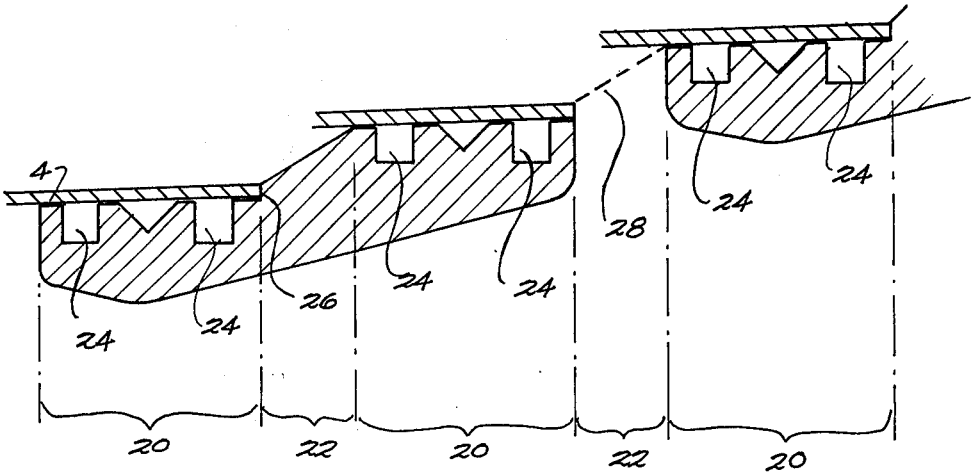
Figure 4:
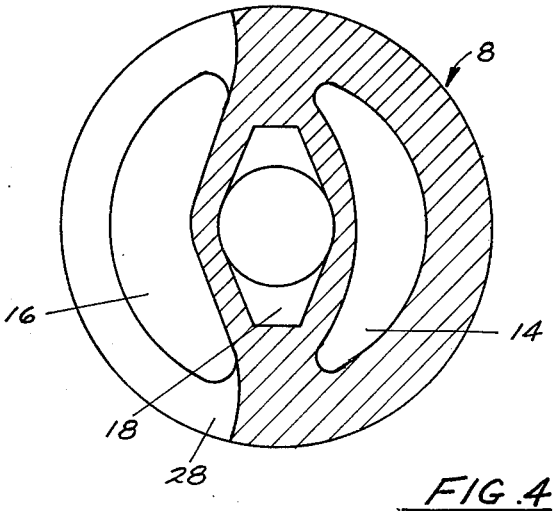
Figure 8:
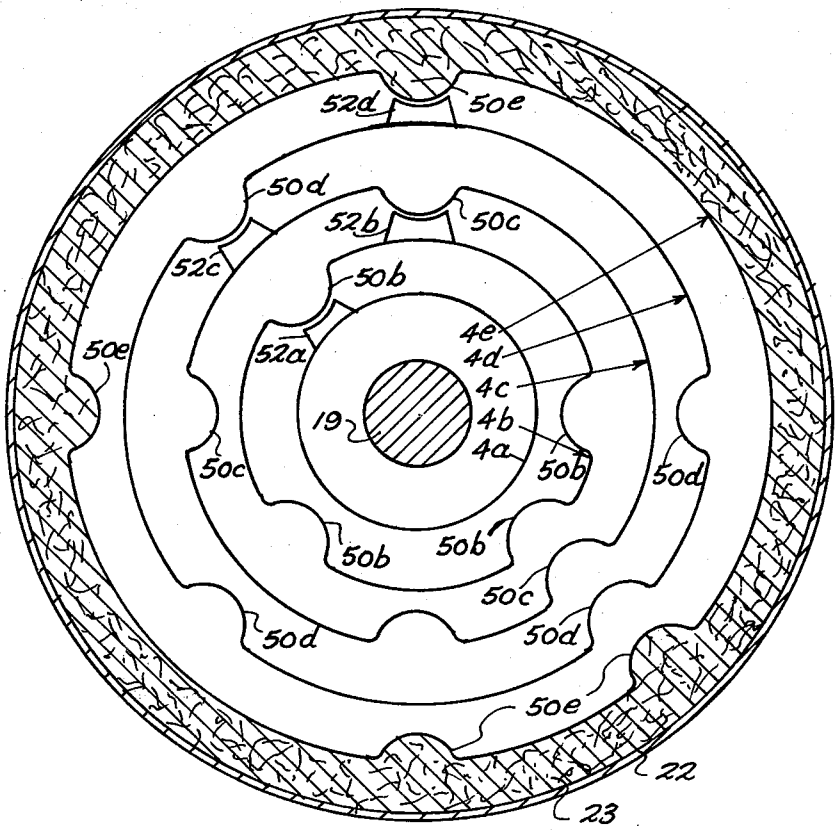

The invention will now be described with reference to the accompanying drawings in which, FIG. 1 is a longitudinal cross-section through a heat exchanger embodying the invention, FIG. 2 is a longitudinal cross-sectional view taken along the line 2—2 marked on FIG. 1, FIG. 3 is a transverse cross-section taken along the line 3—3 marked on FIG. 2, FIG. 4 is a transverse cross-section taken along the line 4—4 marked on FIG. 2, FIG. 5 is a further transverse cross-section view taken along the line 5—5 marked on FIG. 1, FIG. 6 is an end view of the exchanger, FIG. 7 is a detailed view of part of the sealing surfaces of the end manifold of the exchanger, and FIG. 8 is a cross-sectional view of a modified form of the exchanger shown schematically.

The exchanger of the invention comprises a pair of end manifolds 2 between which concentric heat conducting tubes 4 are disposed, a central bore 6 is provided through each of the end manifolds 2 and a long tension bolt (not shown) extends through the bores 6 and through the innermost tube 4 and serves to hold the end manifolds and tubes in their correct position.

In the illustrated arrangement there are five tubes **4*a*, 4*b*, 4*c*, 4*d* and 4*e*** each of which is preferably formed from stainless steel and is provided with a continuous helical groove on its surface so as to improve its heat transfer properties. The spaces between adjacent tubes form annular fluid flow passages for the heat exchanger.

Both end manifolds 2 for the heat exchanger are identical and accordingly it is only necessary to describe the construction of one of the manifolds. It comprises a generally conical portion 8 integrally cast with tubular inlet/outlet spigots 10 and 12. The spigots 10 and 12 permit connection of fluid conduits to the end manifold by conventional means. In the description which follows it will be assumed that the spigot 10 is used an inlet for a first heat transfer fluid and that the spigot 12 is used as an outlet for the second heat transfer fluid, however, it is to be understood that the spigots 10 and 12 can be used interchangeably as inlets and outlets.

The conical portion 8 of the manifold includes an inlet chamber 14 and an outlet chamber 16 in communication respectively with the spigots 10 and 12. The conical portion 8 further includes a central chamber 18 which is generally oval in shape and tapers in the same direction as the conical member 8. The defining walls forming the central chamber 18 are machined out, where necessary, to form the cylindrical bore 6 which extends through the manifold.

The external surface of the conical portion 8 of the manifold comprises a series of generally cylindrical portions 20 spaced axially along the conical portion and adapted to be inserted within respective ends of the tubes, the cylindrical portions 20 being interconnected by tapering transition portions 22, as best seen in FIG. 7. Each cylindrical portion has formed therein two spaced grooves 24 for receipt of O-rings (not shown) for forming positive seals with the inner surfaces of the tubes 4. A shoulder 26 is formed at the leading edge of each of the transition portions 22 so as to form a seat against which the ends of the tubes 4 bear.

Access to the annular fluid passages defined between adjacent tubes 4 is by way of recesses 28 formed into the transition portions 22, as best seen from FIGS. 1 and 4. It is usually desirable that the first and second heat transfer fluids are transmitted through alternate annular passages in the exchanger and therefore it is desirable to arrange for alternate recesses 28 to open into the inlet chamber 14 and for the intermediate recesses 28 to open into the outlet chamber 16.

It has been found that the end manifold 2 of the abovementioned configuration can be cast so as to weigh approximately one third the weight of a comparable manifold of the type disclosed in Australian Pat. No. 402788, thus very substantially reducing the cost of the manifolds and hence the heat exchangers.

An important further advantage can be obtained with the manifold construction described above. This is the ability to sense if any fluid leakage is occurring at the O-rings seated in the slots 24. To this end, a V-groove 30 is machined into the cylindrical portion 20 between the slots 24. Any fluid escaping past the O-rings in the first slot 24 will pass into the groove 30. Radial ducts 32 are provided to communicate the grooves 30 with the central chamber 18 so that any fluid leaking past the O-rings will enter the central chamber 18 and thus cause the pressure within the central chamber 18 to rise sharply. The end openings of the central chamber 18 are sealed against the central bolt (not shown) of the exchanger by means of O-rings seated in slots 34. A sensing hole 36 is provided so as to communicate with the central chamber 18 so as to permit sensing of any build up of pressure within the central chamber, or, alternatively to simply observe fluid which has leaked so that the appropriate remedial action can be taken.

By rotating the tubes relative to one another the relative positions of the helical grooves formed on their surfaces, shown in FIGS. 1 and 2 changes thereby substantially altering the effective fluid flow paths between the tubes. This permits an exchanger to be made having a variable NTU or $\theta$ valve.

FIG. 8 shows schematically one particularly simple technique by which the circumferential adjustment can be effected. The technique involves forming dimples 50 about a circumference of the tubes and providing a complementary projection 52 on the tubes for co-operation with any one of the dimples 30 of an adjacent tube. In the illustrated arrangement each tube has four inwardly extending dimples 50 and each tube has welded to its exterior surface a single projection 52. All of the dimples 50 and projections 52 of the tubes could lie in the same transverse plane, or alternatively, could be spaced axially. However, the innermost tube **4*a* only has a projection 52*a* since it does not require any dimples, and the next largest tube 4*b* has a ring of dimples 50*b* located in the same transverse plane as the projection 52*a*. The projection 52*a* can be made to engage any one of the dimples 50*b* thereby effectively locking the tubes 4*a* and 4*b* together and the phase relationship of their helical grooves depends upon which of the dimples 50*b* is engaged by the projection 52*a***.

The tube **4*b* has a projection 52*b* which may be spaced axially from the dimples 50*b* and lies in the same transverse plane as the dimples 50*c* of the next outermost tube 4*c*, so that the position of the tube 4*c* can be fixed with respect to the tube 4*b*. Similarly, the tubes 4*c* and 4*d* have projections 52*c* and 52*d* arranged to lie in the same transverse planes as the dimples 50*d* and 50*e* of the tubes 4*d* and 4*e*, so that the positions of the tubes 4*d* and 4*e* can be fixed relative to the tubes 4*c* and 4*d* respectively. (The outermost tube 4*e*** does not, of course, require a projection).

FIG. 8 also shows the preferred distribution of dimples 50 about the circumferences of tubes 4, the dimples 50 lie at the following angles relative to the cross-section of the tube 0°, 90°, 180° and 225° thus permitting phase shifts of 45°, 90° and 180° between the helical grooves of any two adjacent tubes.

In an alternative arrangement phase shifts between the helical grooves could be effected by axial shifts of the tubes 4. This could be achieved by inserting spacing shims between the ends of the tubes and the shoulders 26. This arrangement would, of course, be equally effective for non-helical grooves such as discrete circumferential grooves.

FIG. 8 also shows the central longitudinal bolt 19 which extends between the end manifolds 2. Further, it illustrates an outer sheath 52 which covers an insulating layer 53 which is normally provided to avoid heat losses.

The claims defining the invention are as follows:

1. A heat exchanger for fluids comprising a plurality of separate coaxially arranged tubes of thermally conductive material, the tubes being spaced apart radially by and removably clamped between end manifolds to form separate annular fluid flow passages, characterised in that at least one of the manifolds includes cylindrical surface portions extending into the ends of said tubes and resilient sealing elements on said surfaces and which bear against and form seals with the inside surfaces of the ends of the tubes, said manifold also including shoulders against which the ends of the tubes bear.

2. A heat exchanger as caimed in claim 1, wherein the manifolds at either end of the heat exchanger are identical and each has respective sealing elements for each tube.

3. A heat exchanger as claimed in claim 2, wherein the manifolds are generally conical in shape and the sealing elements comprise progressively larger diameter O-rings recessed into sealing surfaces spaced axially along the manifold for cooperating with the interior surfaces of progressively larger diameter tubes of the exchanger.

4. A heat exchanger as claimed in claim 2, wherein each manifold includes a central partition which divides the interior of the manifold into first and second chambers and first and second ports which communicate with the first and second chambers respectively, said ports being located at the wider end of the manifold.

5. A heat exchanger as claimed in claim 4, wherein each manifold includes first openings which interconnect the first chamber with alternate ones of said annular fluid flow passages and second openings which interconnect the second chambers with intermediate ones of said annular fluid flow passages.

6. A heat exchanger as claimed in claim 5, wherein each manifold is formed with a plurality of said shoulders against which the ends of respective tubes bear, and, located adjacent to each shoulder, a pair of grooves which receive respective O-rings which bear against the inner surfaces of the tubes.

7. A heat exchanger as claimed in claim 6, wherein the central partition is formed with a third chamber and communicating ducts are formed between the third chamber and the space between O-rings in each pair thereof.

8. A heat exchanger for fluids as claimed in claim 1 wherein said tubes have corrugated fluid contact surfaces, the tubes being spaced apart radially to form fluid flow passages through which the fluids are caused to flow so that exchange of heat takes place through the corrugated contact surfaces of the tubes, characterized by the tubes being relatively movable to adjust the relative positions of the tubes to effect alteration of said fluid flow passages.

9. A heat exchanger as claimed in claim 8 wherein the corrugations each tube comprise a single continuous helical groove, and the pitch of the helical grooves of all tubes is equal, and wherein said tubes are relatively rotatable to alter the angular position of a groove relative to the groove of an adjacent tube.

10. A heat exchanger as claimed in claim 8 wherein the corrugations of each tube comprise distinct circumferentially disposed, axially spaced apart grooves, and wherein said tubes are relatively movable axially to alter the axial position of one tube relative to another.

11. A heat exchanger as claimed in claim 8 wherein, at least some of the tubes are provided with formations disposed in a ring on the circumference of the tubes, and wherein those tubes which are adjacent to said at least some tubes are provided with a complementary formation, the arrangement being such that the complementary formation is engageable with any of the formations of an adjacent tube so that the relative positions of two adjacent tubes can be set according to which of the formations said complementary formation engages.

* * * * *

UNITED STATES PATENT OFFICE

CERTIFICATE OF CORRECTION

Patent No. 4,146,088 Dated March 27, 1979

Inventor(s) RONALD A. PAIN

It is certified that error appears in the above-identified patent and that said Letters Patent are hereby corrected as shown below:

On the title page, following the filing date, should read:

[30] Foreign Application Priority Data
Apr. 8, 1976 Australia PC5539/76

Signed and Sealed this

*Twenty-first* Day of *August 1979*

[SEAL]

*Attest:*

*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,146,088

DATED : March 27, 1979

INVENTOR(S) : Ronald A. PAIN

It is certified that error appears in the above-identified patent and that said Letters Patent is hereby corrected as shown below:

Claims 8-11 should be deleted.

On the title page, "11 Claims" should read -- 7 Claims --.

Signed and Sealed this

*Third* Day of *July 1984*

[SEAL]

*Attest:*

GERALD J. MOSSINGHOFF

*Attesting Officer*

*Commissioner of Patents and Trademarks*